US007647798B1

(12) United States Patent
Jones et al.

(10) Patent No.: US 7,647,798 B1
(45) Date of Patent: Jan. 19, 2010

(54) LOCK HAVING VARIABLY-SPACED SIDE PINS

(75) Inventors: Mark David Jones, North Las Vegas, NV (US); Drannon Owen Tidwell, Henderson, NV (US)

(73) Assignee: VSR Lock, Inc., Las Vegas, NV (US)

( * ) Notice: Subject to any disclaimer, the term of this patent is extended or adjusted under 35 U.S.C. 154(b) by 0 days.

(21) Appl. No.: 11/425,318

(22) Filed: Jun. 20, 2006

(51) Int. Cl.
*E05B 27/06* (2006.01)

(52) U.S. Cl. ..... 70/358; 70/401; 70/409; 70/495; 70/337

(58) Field of Classification Search ..... 70/358, 70/392, 367, 371–373, 378, 409, 492–496, 70/384
See application file for complete search history.

(56) References Cited

U.S. PATENT DOCUMENTS 3,413,831 A * 12/1968 Crepinsek ..... 70/358
3,673,831 A * 7/1972 Nelson ..... 70/373
4,603,565 A * 8/1986 Strassmeir ..... 70/358
5,050,412 A * 9/1991 Errani ..... 70/358
5,375,444 A * 12/1994 Smith ..... 70/495
6,076,386 A * 6/2000 Etchells et al. ..... 70/369
6,823,702 B2 * 11/2004 Haggstrom ..... 70/358
2003/0037579 A1 * 2/2003 Wu ..... 70/358
2004/0226327 A1 * 11/2004 Chou ..... 70/358

* cited by examiner

*Primary Examiner*—Carlos Lugo
*Assistant Examiner*—Kristina R Fulton
(74) *Attorney, Agent, or Firm*—Lewis and Roca LLP

(57) ABSTRACT

A lock includes a core rotatably disposed within a barrel. A plurality of tumbler pins are disposed in shafts in the core and communicate with a keyway. A side-pin shaft intersects each tumbler pin shaft at a selected angle. Each tumbler pin includes a side hole at a position along its length that aligns with the side-pin shaft when a proper key is inserted. An independent side pin is disposed in each side-pin shaft. One end of each side pin rests against its associated tumbler pin and the other end of each side pin is tapered and extends into a channel in the barrel. The side pins are biased outwardly by a spring towards the channel. The angle at which each side-pin shaft intersects each tumbler shaft may be different. The spacing between tumbler pin shafts may be different.

17 Claims, 4 Drawing Sheets

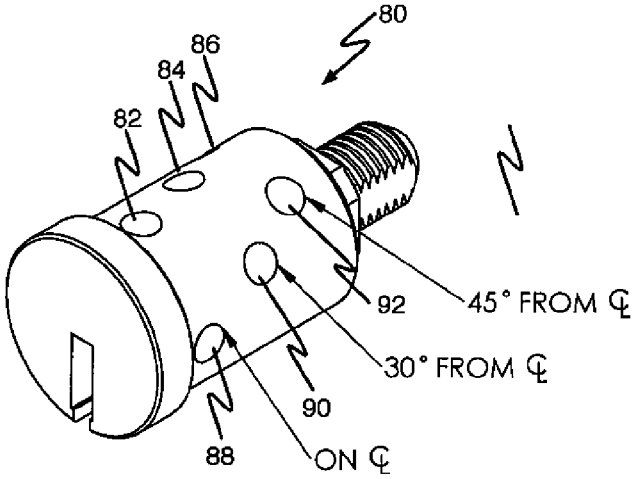
FIGURE 3A
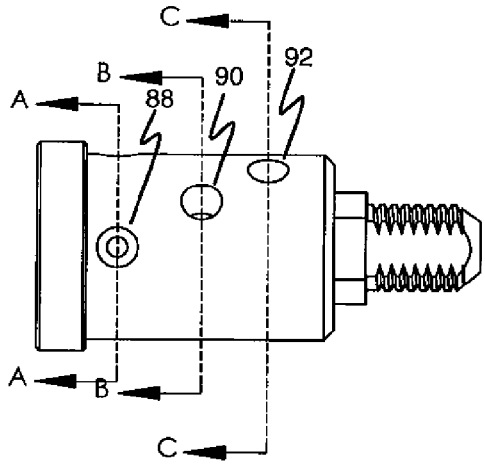
FIGURE 3B
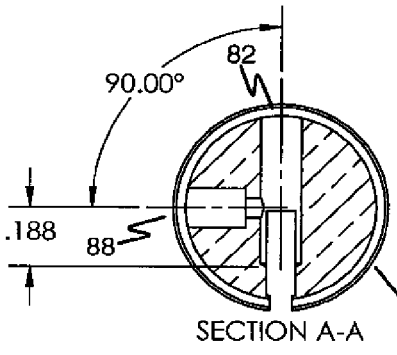
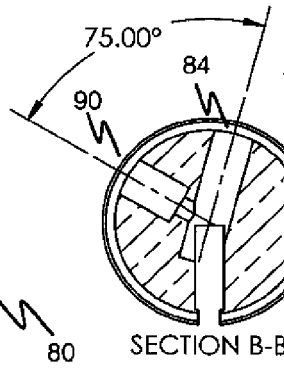
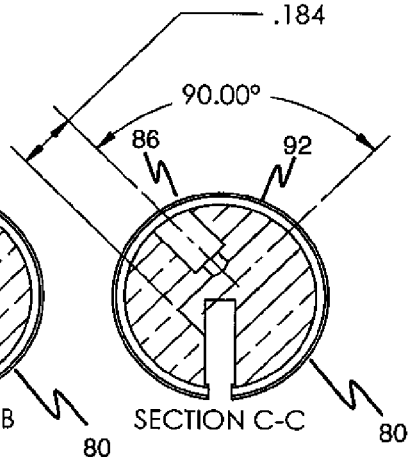
FIGURE 3C FIGURE 3D FIGURE 3E

LOCK HAVING VARIABLY-SPACED SIDE PINS

BACKGROUND OF THE INVENTION

1. Field of the Invention

The present invention relates to locks. More particularly, the present invention relates to locks having both vertical pins and side pins, and to such locks having variable pin spacing.

2. The Prior Art

Conventional locks include a single set of split vertical tumbler pins, each pin disposed in a channel passing between the core and the barrel of the lock and spring-biased towards the center of the core. The channels are evenly spaced along the length of the core and the barrel of the lock. When a proper key is inserted in the lock, it pushes each pin outwardly to a position where the split in each vertical tumbler pin is aligned with the shear line between the core and the barrel of the lock, thus allowing the core to rotate within the barrel.

Another type of conventional lock includes a set of evenly-spaced vertical tumbler pins, each in disposed in a vertical shaft. This type of lock also includes a side bar attached to a set of side pins each disposed in a side shaft in the core. Each side shaft is axially aligned with a corresponding one of the vertical shafts containing the vertical tumbler pins. The side bar is biased in an axially-disposed channel in the barrel of the lock by springs associated with each side pin, thus preventing the core from rotating within the barrel. In such a lock, the vertical pins are not split, but each vertical tumbler pin has a side hole disposed in its side at a selected position along its length. The core cannot rotate within the barrel as long as the side bar is disposed in the channel.

When a properly-cut key is inserted in the lock, it moves each of the vertical tumbler pins to a position where the side hole is aligned with its corresponding side shaft in the core containing a side pin. Turning the properly-cut key causes the side bar to be pushed inward towards the center of the core because the attached side pins are thus allowed to enter the side holes in the vertical tumbler pins, thus allowing the side bar pin to move below the outer diameter of the core. If the hole in any vertical tumbler pin does not align correctly with the side bar pin, the side bar remains in the channel outside the outer diameter of the core and keeps the core from rotating. This key must cause this alignment between the tumbler, core, and side bar pin for all pins incorporated in the lock before the core will rotate to open the lock.

Conventional side bar locks use a single one-piece bar integrated with evenly-spaced side pins all disposed at the same angular position, resulting in a fixed distance between tumbler pins and their corresponding side pins. This fixed distance and fixed angular relationship between each tumbler pin and its corresponding side pin limits the number code combinations, which in turn limits the level of security available in this type of lock.

BRIEF DESCRIPTION OF THE INVENTION

According to the present invention, a lock includes a core rotatably confined within a barrel. A plurality of tumbler pins are disposed in tumbler-pin shafts radially disposed in the core and communicating with a keyway axially disposed in the core. Each tumbler pin includes a side hole formed in its side at a position along its length.

A side-pin shaft communicates with each tumbler pin shaft and has an axis that intersects the axis of its tumbler pin shaft at a selected angle. Each tumbler-pin shaft and associated tumbler pin has a cross section that is other than circular to prevent the tumbler pin from rotating within its shaft in order to maintain the side hole in alignment with the axis of the side-pin shaft. An individual independent side pin is disposed in each side-pin shaft. One end of each side pin rests against the side of its associated tumbler pin and the other end of each side pin is tapered and extends into a longitudinal channel disposed in the inner surface of the barrel of the lock. The side pins are biased outwardly by a spring into the channel. Without a proper key inserted into the lock, the side pins cannot move out of the channel thus preventing the core from rotating within the barrel.

When a properly-cut key is inserted in the lock, it moves each of the vertical tumbler pins into a position where its side hole is aligned with its corresponding side shaft in the core containing a side pin. Turning the properly-cut key allows the tapered end of each side pin to be pushed out of the channel in the barrel and into its tumbler-pin side hole towards the center of the core, thus allowing the side pins to move below the outer diameter of the core. If the hole in any vertical tumbler pin does not align correctly with its side pin, the side pin remains in the channel outside the outer diameter of the core and keeps the core from rotating. This key must cause this alignment between the tumbler, core, and side pin for all pin positions in the lock before the core will rotate to open the lock.

According to another aspect of the present invention, two additional degrees of freedom are provided for the lock of the present invention. First, the angle at which the axis of each side-pin shaft makes with the axis of each tumbler shaft may be the same or may be different for each intersection. A separate channel must be provided in the barrel of the lock for each separate side-pin shaft angle. In addition, the spacing between the tumbler pin shafts may be uniform or may be different between adjacent tumbler pin shafts. By using different combinations of one or both of these parameters, the number of key combinations for the lock of the present invention is significantly increased.

BRIEF DESCRIPTION OF THE DRAWING FIGURES

FIG. 3A is an isometric drawing of the core of another illustrative embodiment of a lock according to the principles of the present invention illustrating another feature of the present invention.

FIG. 3B is a side view of the core of FIG. 3A.

FIGS. 3C, 3D, and 3E are cross sectional views taken through the three sets of pin shafts in the core of FIGS. 3A and 3B.

FIGS. 4A through 4E are various views of a key for use in the lock shown in FIGS. 3A through 3E.

DETAILED DESCRIPTION OF THE INVENTION

Those of ordinary skill in the art will realize that the following description of the present invention is illustrative only and not in any way limiting. Other embodiments of the invention will readily suggest themselves to such skilled persons.

Figure 1A:
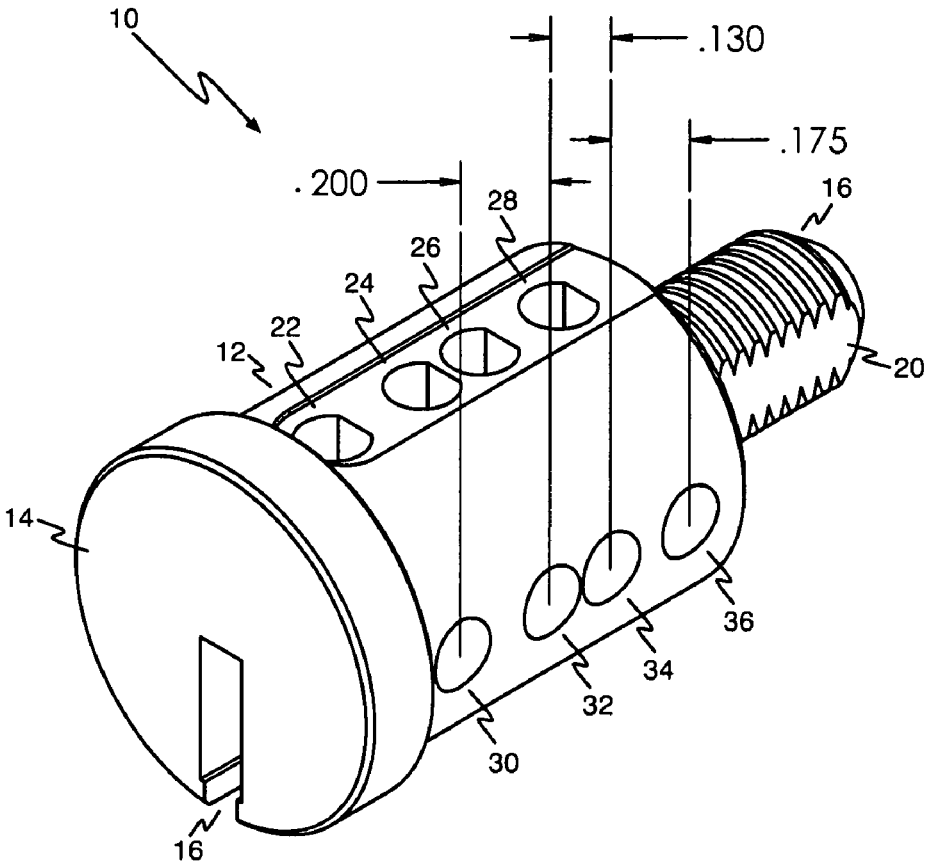
FIG. 1A is an isometric drawing of the core of an illustrative embodiment of a lock according to the principles of the present invention.

Referring first to FIG. 1A, an isometric drawing shows the core 10 of an illustrative embodiment of a lock according to the principles of the present invention. Core 10 is cylindrical in shape and includes a body 12 having a face portion 14. A keyway 16 is machined in core 10 along its cylindrical axis into which a key may be inserted. A stem 18 extends from the rear of core 10 and is provided with at least one chamfer 20 adapted to accept a cam as is known in the art.

A plurality of tumbler-pin shafts are formed in body 12, each having an axis perpendicular to the cylindrical axis of the body and communicating with the keyway 16. Four tumbler-pin shafts 22, 24, 26, and 28 are shown formed in body 12, although persons of ordinary skill in the art will appreciate that this number has been chosen for purposes of illustration only and that other numbers of tumbler-pin shafts may be utilized in locks fabricated according to the principles of the present invention.

A plurality of side-pin shafts 30, 32, 34, and 36 are also formed in body 12, each having an axis that is perpendicular to the cylindrical axis of the body and intersects the axis of a corresponding tumbler pin shaft. Thus, side-pin shaft 30 intersects tumbler-pin shaft 22, side-pin shaft 32 intersects tumbler-pin shaft 24, side-pin shaft 34 intersects tumbler-pin shaft 26, and side-pin shaft 36 intersects tumbler-pin shaft 28. Each of side-pin shafts 30, 32, 34, and 36 is disposed at an angle with respect to the axis of its corresponding tumbler-pin shaft 22, 24, 26, and 28. As may be seen from FIG. 1A, the tumbler-pin shafts 22, 24, 26, and 28 are not evenly spaced, although in some embodiments they may be evenly spaced according to the present invention.

In the illustrative embodiment shown in FIG. 1A, the side-pin shafts are shown intersecting the tumbler-pin shafts and are all shown disposed at an angle of about 90° with respect to the tumbler-pin shafts. This may be more easily seen from an examination of FIG. 1B, a cross-sectional view of the core of FIG. 1A taken through the axes of one of the pairs of tumbler-pin shafts and side-pin shafts.

Figure 1B:
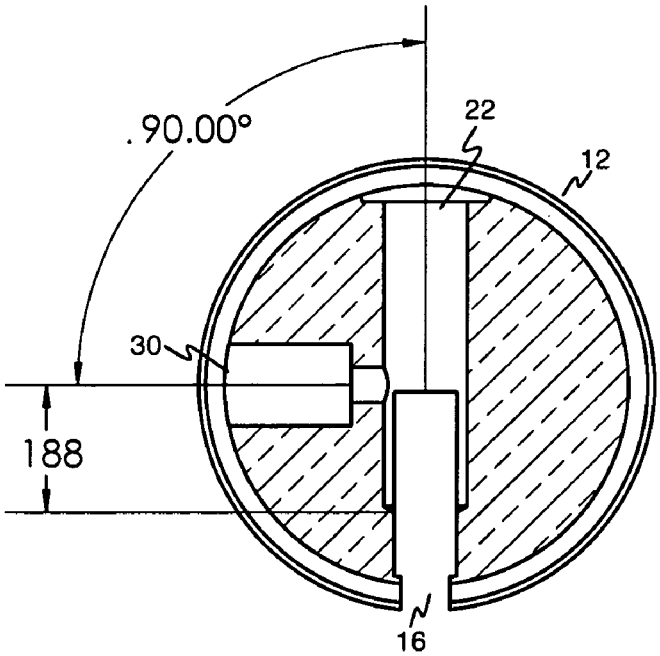
FIG. 1B is a cross-sectional view of the core of FIG. 1A taken through the axes of one of the pairs of tumbler-pin shafts and side-pin shafts.
Figure 2B:
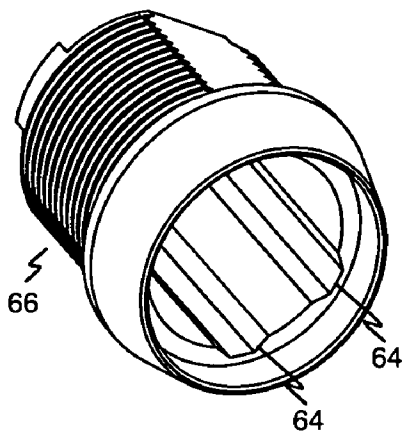
FIG. 2B is a perspective view of the barrel of FIG. 2A, showing the channel.
Figure 2A:
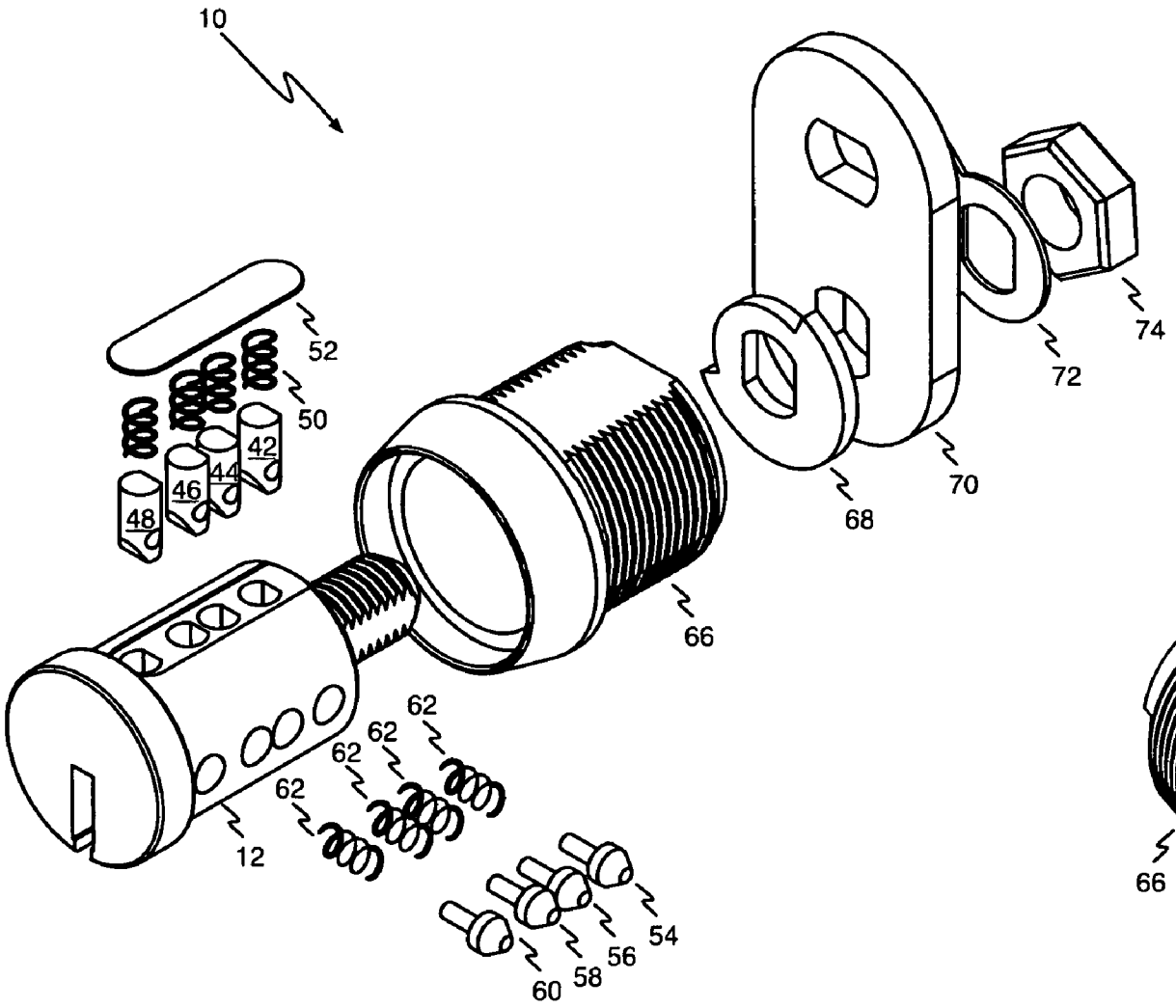
FIG. 2A is an exploded view of the components of an illustrative embodiment of a lock according to the principles of the present invention.

FIG. 2A is an exploded view of the components of an illustrative embodiment of a lock 40 employing the core 12 shown in FIGS. 1A and 1B according to the principles of the present invention. The lock includes core 12 having tumbler-pin shafts into which tumbler pins 42, 44, 46, and 48 are inserted, biased with springs 50 and held in by pin cover 52. Each tumbler pin has a side hole 54 oriented in alignment with the side-pin shafts.

The side holes 54 in individual locks fabricated according to the principles of the present invention are individually located at positions along the lengths of tumbler pins 42, 44, 46, and 48 to align with the axes of the side-pin shafts when a key mated with the individual lock having the proper key cut depths is inserted into keyway 16 of the core 12. Side pins 54, 56, 58, and 60 are disposed in side-pin shafts and are biased with springs 62. The ends of side pins 54, 56, 58, and 60 disposed proximate to the tumbler pins are sized to fit into side holes 54 of the tumbler pins 42, 44, 46, and 48. The other ends of side pins 54, 56, 58, and 60 are tapered to allow them to slide along the edge of a channel 64 formed along the length of the barrel 66 at a radial position corresponding to the radial position of the side pins 54, 56, 58, and 60 in core 12. Different channels 64 to accommodate side pins at different angles (as shown in FIGS. 3A through 3E) are shown in FIG. 2B.

Core 12 fits rotatably within barrel 66 with the tapered ends of side pins 54, 58, 60, and 62 extending into the channel formed in barrel 66. A stop cam 68 and actuating cam 70 are mounted on stem 18 at the rear of core 12 by washer 72 and nut 74 as is known in the art.

Referring now to FIGS. 3A through 3E, the core 80 of another illustrative embodiment of a lock according to the principles of the present invention in order to illustrate another feature of the present invention. In FIG. 3A, an isometric drawing shows the core 80. FIG. 3B is a side view of the core 80 of FIG. 3A, and FIGS. 3C, 3D, and 3E are cross sectional views taken through the three sets of pin shafts in the core 80. The illustrative core 80 shown in FIGS. 3A through 3E includes three tumbler pins 82, 84, and 86, and corresponding side pins 88, 90, and 92, although persons of ordinary skill in the art will appreciate that this number has been chosen for purposes of illustration only and that other numbers of tumbler-pin shafts and side-pin shafts may be utilized in locks fabricated according to the principles of the present invention.

As illustrated in FIGS. 3A and 3C, the axes of the front tumbler-pin shaft 82 and side-pin shaft 88 are oriented at an angle of 90° from one another and are oriented in the horizontal and vertical planes, respectively. As illustrated in FIGS. 3A and 3D, the axes of the center tumbler-pin shaft 84 and side-pin shaft 90 are oriented at an angle of 75° from one another and the side-pin shaft is offset from the horizontal plane by an angle of 30°. As illustrated in FIGS. 3A and 3E, the axes of the rear tumbler-pin shaft 86 and side-pin shaft 92 are oriented at an angle of 90° from one another and the side-pin shaft is offset from the horizontal plane by an angle of 45°.

Figure 4B:
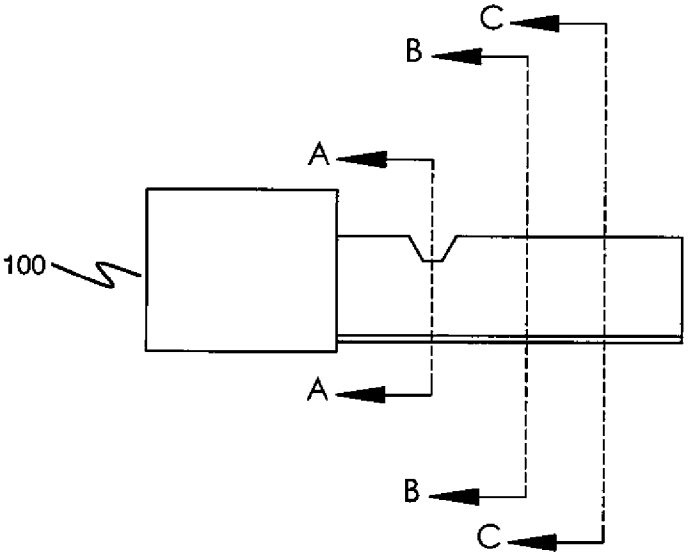
Figure 4A:
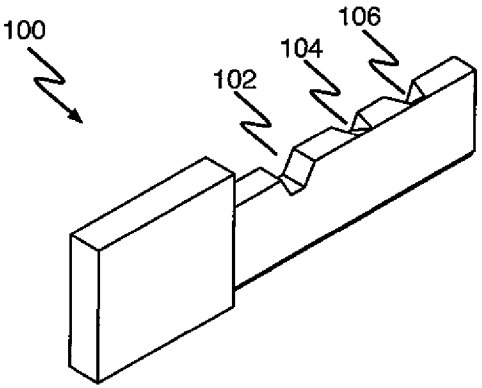

Referring now to FIGS. 4A through 4E, various views are shown of a key for use in the lock shown in FIGS. 3A through 3E. In FIG. 4A, an isometric drawing of a typical key 100 is presented. Key 100 includes three notches 102, 104, and 106, corresponding to the three tumbler pins 82, 84, and 86 in the core 80 of FIGS. 3A through 3E. Notch 102 is cut at an angle of 0° (i.e., is oriented horizontally) to match the angle at which tumbler pin 82 will engage it. Similarly, notch 104 is cut at an angle of 30° to match the angle at which tumbler pin 84 will engage it, and notch 106 is cut an angle of 45° to match the angle at which tumbler pin 86 will engage it.

Figure 4E:
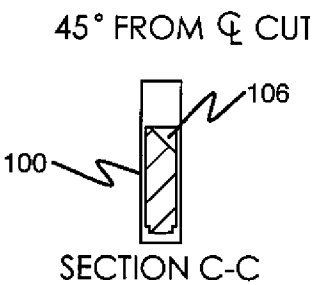
Figure 4D:
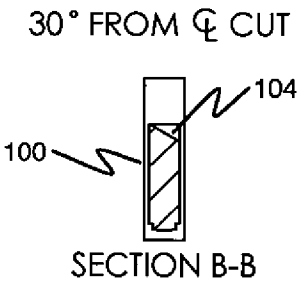
Figure 4C:
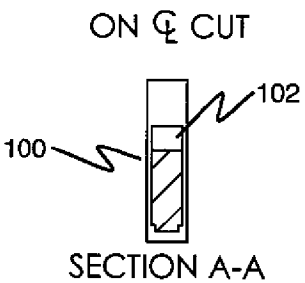

FIG. 4B is a side view of the key of FIG. 4A, and FIGS. 4C, 4D, and 4E are cross sectional views taken through three positions at lines A-A, B-B, and C-C, respectively on the key corresponding to the key cuts to personalize the key. Thus, FIG. 4C shows a front view of the 0° angle cut of notch 102, FIG. 4D shows a front view of the 30° angle cut of notch 104, and FIG. 4E shows a front view of the 45° angle cut of notch 106.

While the invention has been described with reference to exemplary embodiments, it will be understood by those skilled in the art that various changes may be made and equivalents may be substituted for elements thereof without departing from the scope of the invention.

What is claimed is:

1. A lock including:

a barrel;

a core rotatably disposed within the barrel and having an axial keyway formed therein;

a plurality of tumbler bores axially disposed along only a single row in the core and communicating with the keyway, each tumbler bore having a uniform non-circular cross section;

a plurality of tumbler pins, each tumbler pin disposed in one of the tumbler bores and biased inwardly towards the keyway, each tumbler pin having a uniform cross section substantially matching that of the tumbler bores so as to allow each tumbler pin to move axially but not radially within the bore in which that tumbler pin is disposed;

a plurality of sidepin bores, each sidepin bore formed along an axis that intersects only a single different tumbler pin bore at a selected angle, the selected angle for each sidepin bore being different from the selected angle of other sidepin bores;

for each different selected angle, a mating longitudinal channel formed in the barrel, each sidepin bore aligning with one of the mating longitudinal channels in the barrel when the core is disposed at a locked rotational position within the barrel;

an independently movable side pin disposed in each sidepin bore and biased towards one of the longitudinal sidepin channels in the barrel, a first end of each side pin resting against a tumbler pin and a second end of each side pin extending into the mating channel in the barrel when the core is disposed at a locked rotational position within the barrel;

wherein each tumbler pin includes a non-circumferential side hole disposed at a position along its length, said position radially aligned with the axis of the side pin bore intersecting the tumbler pin bore in which the tumbler pin is disposed, each side hole aligning with the side-pin bore when a proper key is inserted to allow the sidepin to move inwardly through the sidepin bore in which the sidepin is disposed into the side hole;

and wherein the spacing between tumbler pin bores is non-uniform.

2. The lock of claim 1 wherein each tumbler pin and each side pin is biased by a spring.

3. The lock of claim 1 wherein the second end of each sidepin disposed in the mating channel is shaped so as to be urged inwardly towards the core when the core is rotated within the barrel.

4. The lock of claim 3 wherein the second end of each sidepin disposed in the channel is tapered.

5. The lock of claim 1 wherein the angle of intersection of each side-pin bore and tumbler bores is different from the angle of intersection of each other side-pin bore and tumbler bore, each sidepin bore aligning with a separate mating channel in the barrel when the core is disposed at a locked rotational position within the barrel.

6. The lock of claim 5 wherein each tumbler pin and each side pin is biased by a spring.

7. The lock of claim 5 wherein the second end of each sidepin disposed in the mating channel is shaped so as to be urged inwardly towards the core when the core is rotated within the barrel.

8. The lock of claim 7 wherein the second end of each sidepin disposed in the mating channel is tapered.

9. A lock including:

a barrel;

a core rotatably disposed within the barrel and having an axial keyway formed therein;

a plurality of tumbler bores axially disposed along only a single row in the core and communicating with the keyway, each tumbler bore having a uniform non-circular cross section;

a plurality of tumbler pins, each tumbler pin disposed in one of the tumbler bores and biased inwardly towards the keyway, each tumbler pin having a uniform cross section substantially matching that of the tumbler bores so as to allow each tumbler pin to move axially but not radially within the bore in which that tumbler pin is disposed;

a plurality of sidepin bores, each sidepin bore formed along an axis that intersects only a single different tumbler pin bore at a selected angle, the selected angle for a first sidepin bore being different from the selected angle of a second sidepin bore;

for each different selected angle, a mating longitudinal channel formed in the barrel, each sidepin bore aligning with a mating longitudinal channel in the barrel when the core is disposed at a locked rotational position within the barrel;

an independently movable side pin disposed in each sidepin bore and biased towards a longitudinal sidepin channel in the barrel, a first end of each side pin resting against a tumbler pin and a second end of each side pin extending into the mating channel in the barrel when the core is disposed at a locked rotational position within the barrel;

wherein each tumbler pin includes a non-circumferential side hole disposed at a position along its length, said position radially aligned with the axis of the side pin bore intersecting the tumbler pin bore in which the tumbler pin is disposed, each side hole aligning with the side-pin bore when a proper key is inserted to allow the sidepin to move inwardly through the sidepin bore in which the sidepin is disposed into the side hole;

and wherein the spacing between tumbler pin bores is non-uniform.

10. The lock of claim 9 wherein the spacing between tumbler pin bores is non-uniform.

11. The lock of claim 1 wherein each tumbler pin and each side pin is biased by a spring.

12. The lock of claim 1 wherein the second end of each sidepin disposed in the mating channel is shaped so as to be urged inwardly towards the core when the core is rotated within the barrel.

13. The lock of claim 3 wherein the second end of each sidepin disposed in the channel is tapered.

14. The lock of claim 1 wherein the angle of intersection of each side-pin bore and tumbler bores is different from the angle of intersection of each other side-pin bore and tumbler bore, each sidepin bore aligning with a separate mating channel in the barrel when the core is disposed at a locked rotational position within the barrel.

15. The lock of claim 5 wherein each tumbler pin and each side pin is biased by a spring.

16. The lock of claim 5 wherein the second end of each sidepin disposed in the mating channel is shaped so as to be urged inwardly towards the core when the core is rotated within the barrel.

17. The lock of claim 7 wherein the second end of each sidepin disposed in the mating channel is tapered.

* * * * *